US005323213A

United States Patent [19]

Ahn

[11] Patent Number: 5,323,213

[45] Date of Patent: Jun. 21, 1994

[54] DRIVE SYSTEM OF AN ELECTRO-PHOTOGRAPHY PROCESS UNIT

[75] Inventor: Byung-Seon Ahn, Suwon, Rep. of Korea

[73] Assignee: SamSung Electronics Co., Ltd., Suwon, Rep. of Korea

[21] Appl. No.: 976,186

[22] Filed: Nov. 13, 1992

[30] Foreign Application Priority Data

Nov. 25, 1991 [KR] Rep. of Korea ..... 1991-21174

[51] Int. Cl.[5] ..... G03G 15/00

[52] U.S. Cl. ..... 355/210; 355/200; 355/211; 355/245; 355/296

[58] Field of Search ..... 355/200, 210, 211, 296, 355/245, 301

[56] References Cited

U.S. PATENT DOCUMENTS

| | | | |
|---|---|---|---|
| 4,298,268 | 11/1981 | Sato et al. | 355/211 |
| 4,985,731 | 1/1991 | Sakakura et al. | 355/210 |
| 5,023,660 | 6/1991 | Ebata et al. | 355/200 |
| 5,028,966 | 7/1991 | Kozuka et al. | 355/210 X |
| 5,051,783 | 9/1991 | Sato | 355/296 X |
| 5,115,281 | 5/1992 | Otsuka et al. | 355/319 |
| 5,126,800 | 6/1992 | Shishido et al. | 355/211 |
| 5,138,372 | 8/1992 | DeCecca | 355/200 |
| 5,142,322 | 8/1992 | Surti | 355/200 |
| 5,151,734 | 9/1992 | Tsuda et al. | 355/200 |
| 5,182,601 | 1/1993 | Hodoshima et al. | 355/245 X |
| 5,235,383 | 10/1993 | Tada et al. | 355/200 |
| 5,237,377 | 8/1993 | Harada et al. | 355/301 |
| 5,258,811 | 11/1993 | Miyake et al. | 355/210 |

*Primary Examiner*—Matthew S. Smith
*Attorney, Agent, or Firm*—Robert E. Bushnell

[57] ABSTRACT

A drive system of an electro-photography process unit, which uses a drum gear mounted on one end of a shaft of a photo-sensitive drum for receiving the motion of a drive gear of a motor via an idle gear to drive the drum, a sleeve gear engaged with the drum gear for driving a sleeve of a developer arranged on one side of the drum with a space between the sleeve and the drums, a cleaning gear engaged with the drum gear for driving a cleaning roll of a cleaning device arranged on the other side of the drum, the cleaning gear being positioned on the opposite side of the drum with respect to the sleeve gear, another drum gear mounted on the other end of the shaft of the drum for preventing deviation of the drum, another sleeve gear engaged with the other drum gear for preventing deviation of the sleeve, and another cleaning gear engaged with the other drum gear for preventing deviation of the cleaning roll.

7 Claims, 4 Drawing Sheets

DRIVE SYSTEM OF AN ELECTRO-PHOTOGRAPHY PROCESS UNIT

TECHNICAL BACKGROUND

The present invention relates to a drive system of an electro-photography process unit.

Referring to FIG. for illustrating a conventional electro-photography process unit, the surface of a photo-sensitive drum 28 is uniformly charged with a constant voltage electric charger 25 and then exposed to the light of a lamp 24 reflected from an original document placed on a platen glass 21, so that an electrostatic latent image is formed on the photo-sensitive drum 28 corresponding to the image of the document. The light source may be a laser scanning unit, light emitting diode, etc. Thereafter, as the photo-sensitive drum 28 is rotated, the toner of a developer 27 is attracted to the surface of the photo-sensitive drum 28 so as to develop the latent,. image transferred by a transfer means 32 to a sheet of paper 31 supplied by a supply roll 20.

The paper adhering to the photo-sensitive drum 28 by the electrostatic force is separated by a separator 33 therefrom. Then the paper is conveyed by a conveyor belt 30 to a fixing means 40, where the paper is heated and pressed between a heat roll 34 and pressure roll 35 to fix the toner, conveyed to a discharging tray 39.

The residual toner on the photo-sensitive drum 28 is removed by a cleaning blade 29 and the latent image is canceled by the light supplied from a pre-erase lamp array 37.

Referring to FIGS. 3A and 3B, the rotation of the drum 28 is preformed by the rotational force of the drive gear 22 of a motor being transmitted via an idle gear 23 to a drum gear **28*a* mounted on one end of the shaft of the drum 28. The developer 27 arranged in one side of the drum 28 has a sleeve 27*b* with a sleeve gear 27*a* that is driven by the drum gear 28*a* to rotate the magnet roll of the developer. On the opposite side of the drum with respect to the developer 27, is arranged the cleaning blade 29 attached by means of a fixing pin inserted in a slot formed in the base. The cleaning blade 29 has a cleaning roll 29*b* whose shaft has at one end a cleaning gear 29*a* engaged with the drum gear 29*a***.

Such a conventional drive system has a drawback that the gaps between the drum 28 and sleeve **27*b* and cleaning blade 29 are not kept constant as shown in FIG. 3A because the shaft of the drum 28 receives the torque of the drum gear 28*a*** only at one end so that the relative positions of the drum, sleeve and cleaning blade are deviated from their original positions during the operation.

SUMMARY OF THE INVENTION

It is an object of the present invention to provide means for preventing the deviation of the relative positions of the drum, sleeve and cleaning blade in a drive system of an electrophotography process unit, whereby the picture quality of a reproduced document is improved together with the cleaning effect of the drum.

According to the present invention, a drive system of an electro-photography process unit comprises a drum gear mounted on one end of a shaft of a photo-sensitive drum for receiving the motion of a drive gear of a motor via an idle gear to drive the drum, a sleeve gear engaged with the drum gear for driving a sleeve of a developer arranged on one side of the drum with a space, a cleaning gear engaged with the drum gear for driving a cleaning roll of a cleaning device arranged on the other side of the drum, the cleaning gear, being positioned on the opposite side of the drum with respect to the sleeve gear, another drum gear mounted on the other end of the shaft of the drum for preventing deviation of the drum, A second sleeve gear engaged with a second drum gear for preventing deviation of the sleeve, and a second cleaning gear engaged with the second drum gear for preventing deviation of the cleaning roll.

The present invention will now be described more specifically with reference to the drawings attached only by way of example.

BRIEF DESCRIPTION OF ATTACHED DRAWINGS

FIG. 1 is a schematic diagram for illustrating the structure of a conventional electro-photography process unit; FIG. 2 is an enlarged side view of a part of FIG. 1; FIG. 3A is a schematic plane view of a conventional drive system; FIG. 3B is an elevational view of FIG. 3A; FIG. 4A is a schematic plane view of a drive system according to the present invention; and FIG. 4B is a rear view of FIG. 4A.

DETAILED DESCRIPTION OF A CERTAIN PREFERRED EMBODIMENT

Figure 1:
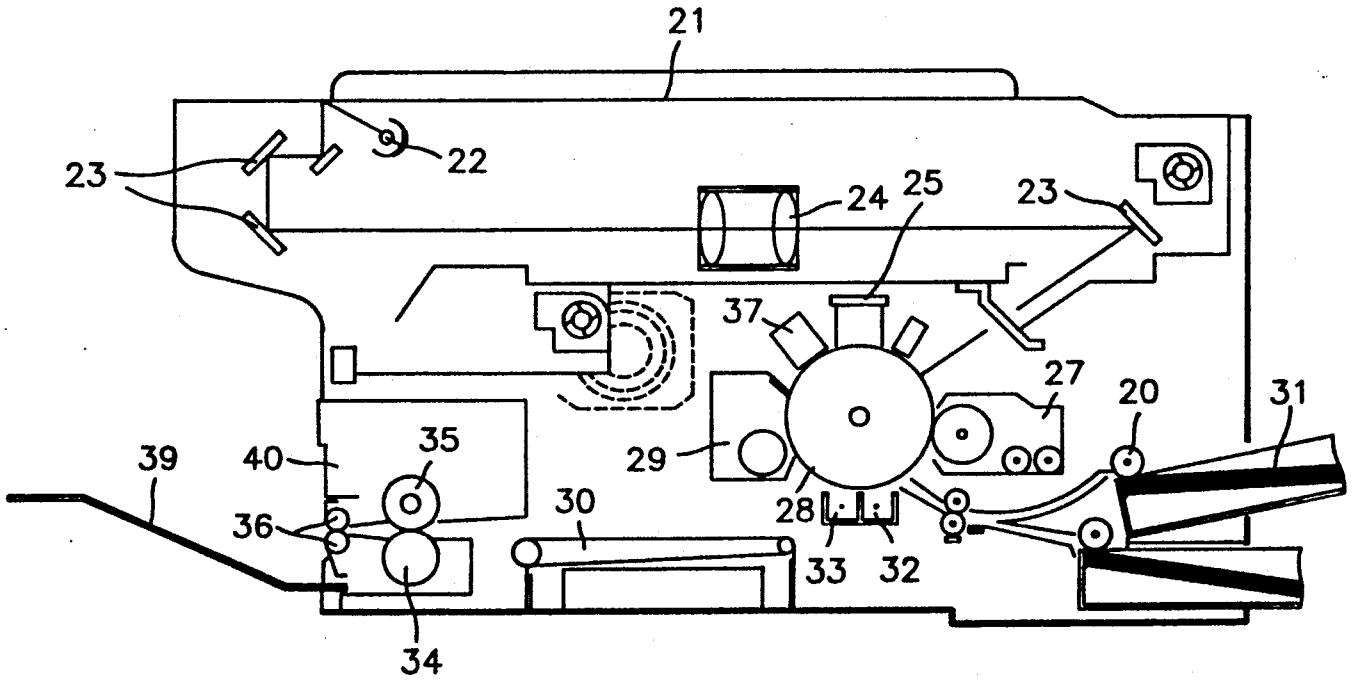
FIG. 1 PRIOR ART
Figure 2:
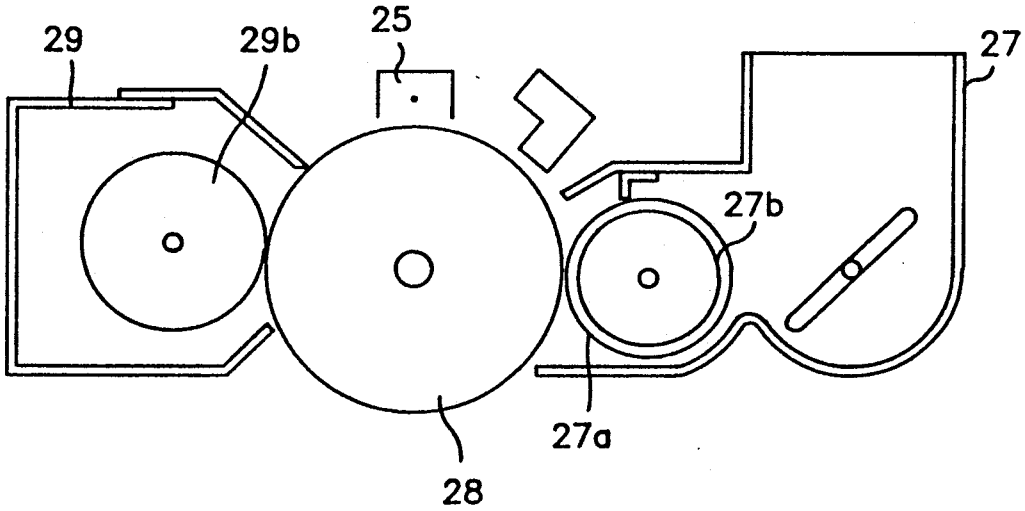
FIG. 2 PRIOR ART
Figure 3A:
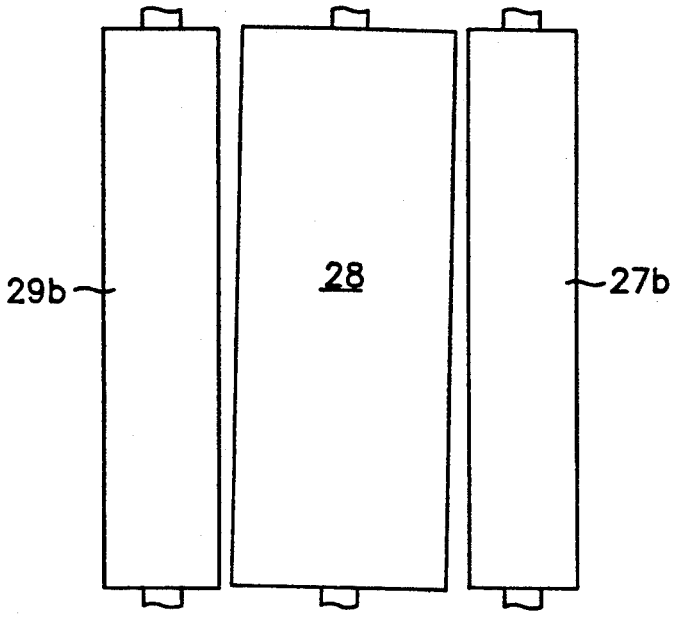
FIG. 3A PRIOR ART
Figure 3B:
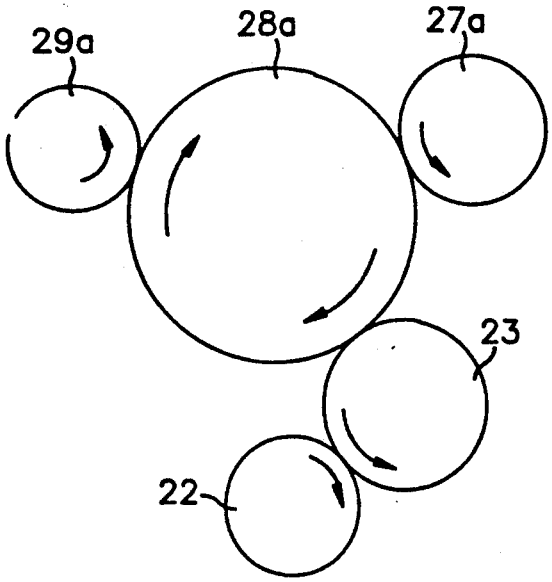
FIG. 3B PRIOR ART
Figure 4A:
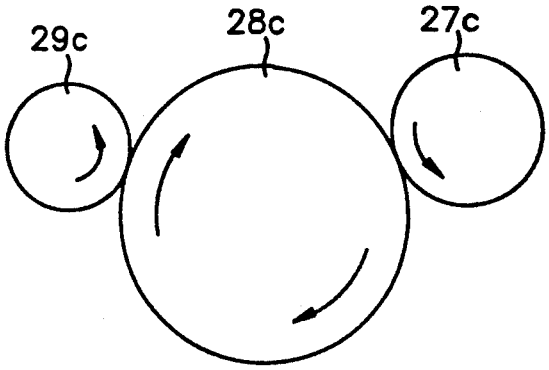
Figure 4B:
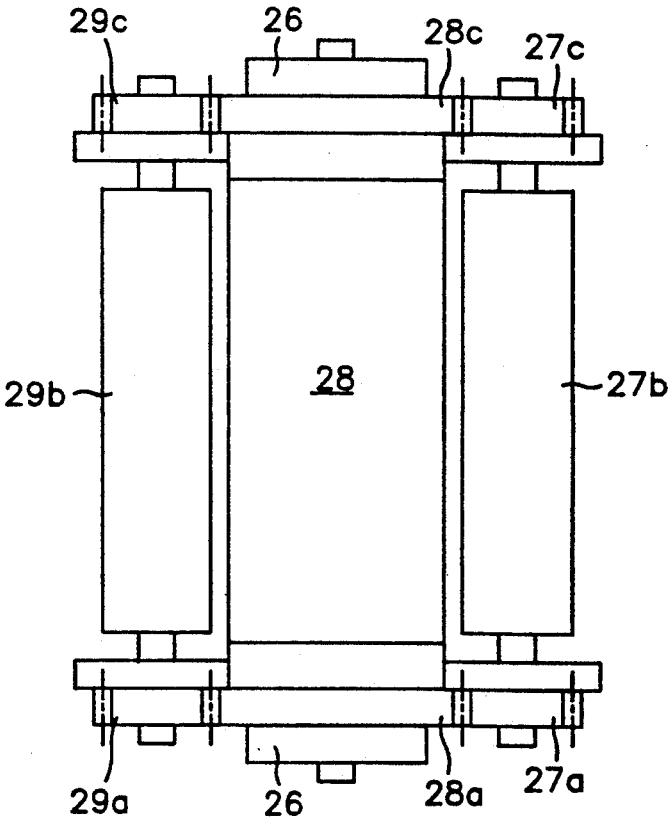

Referring to FIGS. 4A and 4B, a photo-sensitive drum 28 attached to a guide frame 26 has a drum gear **28*a* that is driven by a drive gear 22 of a drive motor. On one side of the drum 28 is arranged a developer 27 with a sleeve gear 27*a* that is driven by the drum gear 28*a*. The developer 27 has a sleeve 27*b* to which is attached the sleeve gear 27*a*. A cleaning device 29 is arranged on the opposite side of the drum with respect to the developer 27 with a cleaning gear 29*a* engaged with the drum gear 28*a*. The drum has at the other end another drum gear 28*c* for preventing deviation of the drum. Engaged with the second drum gear 28*c* sleeve are a second sleeve gear 27*c* mounted on the other end of the sleeve 27*b* and a second cleaning gear 29*c* mounted on the other end of a cleaning roll 29*b* of the cleaning device 29**. These additional gears are to prevent deviation of the drum, sleeve and cleaning roll from their original relative positions.

In operation, the drum 28 is rotated by the drive gear 22 of the drive motor driving the drum gear **28*a* via the idle gear 23. In this case the second drum gear 28*c* is also rotated together with the drum 28. The sleeve 27*b* of the developer 27 is rotated by the sleeve gear 27*a* that is driven by the drum gear 28*a*. The cleaning roll 29*b* is rotated by the cleaning .gear 29*a* that is also driven by the drum gear 28*a*. Since the second sleeve gear 27*c* and cleaning gear 29*c* are engaged with the second gear 28*c* and rotated together with the gears 28*a*, 27*a* and 29*a*, the torque of the drive motor is not concentrated on the drum gear 28*a*** but distributed over all the gears, so that the relative positions between the drum and developer and cleaning device are kept constant. Thus the picture quality of the reproduced document is improved together with the cleaning effect of the drum.

What is claimed is:

1. A drive system of an electro-photography process unit comprising:

a first drum gear mounted on a first end of a shaft of a photo-sensitive drum for receiving motion of a drive gear of a motor via an idler gear to drive said photo-sensitive drum;

a first sleeve gear engaged with said first drum gear, for driving a sleeve of a developer arranged at a first side of said photo-sensitive drum, said sleeve being spaced apart from said photo-sensitive drum;

a first cleaning gear engaged with said first drum gear, for driving a cleaning roll of a cleaning device arranged at a second side of said photo-sensitive drum, said first cleaning gear being positioned at a second side of said photo-sensitive drum opposite said first side;

a second drum gear mounted on a second end of the shaft of said photo-sensitive drum for preventing deviation of said photo-sensitive drum;

a second sleeve gear engaged with said second drum gear for preventing deviation of said sleeve; and a second cleaning gear engaged with said second drum gear for preventing deviation of said cleaning roll; and a guide frame attached to said photo-sensitive drum for maintaining a uniform gap between said photo-sensitive drum and said sleeve, and between said photo-sensitive drum and said cleaning roll.

2. A drive system of an electro-photography process unit having a photo-sensitive drum, a sleeve of a developer and a cleaning roll of a cleaning unit, said drive system comprising:

a first drum gear attached to a first end of the drum and receiving motive power, for rotating the drum;

a first sleeve gear attached to a first end of the sleeve and meshing with said first drum gear, for rotating the sleeve in response to said rotation of the drum;

a first cleaning gear attached to a first end of the cleaning roll and meshing with said first drum gear, for rotating the cleaning roll in response to said rotation of the drum;

a second drum gear attached to a second end of the drum and rotating in response to said rotation of the drum;

a second sleeve gear attached to a second end of the sleeve and meshing with said second drum gear, for maintaining a first uniform gap between the drum and the sleeve; and a second cleaning gear attached to a second end of the cleaning roll and meshing with said second drum gear, for maintaining a second uniform gap between the drum and the cleaning roll; and a guide frame attached to said first and second ends of said photo-sensitive drum for further maintaining the uniformity of said first and second gaps.

3. A drive system for an electro-photography process unit having a photo-sensitive drum, a sleeve of a developer and a cleaning roll of a cleaning unit, said drive system comprising:

drum gear means attached to said photo-sensitive drum, said drum gear means driven by drive gear means;

sleeve gear means attached to said sleeve, said sleeve gear means driven by said drum gear means;

cleaning gear means attached to said cleaning roll, said cleaning gear means driven by said drum gear means;

guide frame means attached to said photo-sensitive drum for maintaining a uniform gap between said photo-sensitive drum and said sleeve and between said photo-sensitive drum and said cleaning roll.

4. A drive system of an electro-photography process unit having a photo-sensitive drum, a sleeve of a developer and a cleaning roll of a cleaning unit, said drive system comprising:

a first drum gear attached to a first end of the drum and receiving motive power, for rotating the drum, a first sleeve gear attached to a first end of the sleeve and meshing with said first drum gear, for rotating the sleeve in response to said rotation of the drum;

a first cleaning gear attached to a first end of the cleaning roll and meshing with said first drum gear, for rotating the cleaning roll in response to said rotation of the drum;

means attached to a second end of the drum and rotating in response to said rotation of the drum;

means attached to a second end of the sleeve and connected to said means attached to said second end of the drum, for maintaining a first uniform gap between the drum and the sleeve; and means attached to a second end of the cleaning roll and connected to said means attached to said second end of the drum, for maintaining a second uniform gap between the drum and the cleaning roll; and guide frame means attached to said first and second ends of said drum, said guide frame means further maintaining the uniformity of said first and second gaps.

5. A drive system of an electro-photography process unit comprising:

a photo-sensitive drum for receiving an electrostatic latent image;

a sleeve of a developer positioned on a first side of said photo-sensitive drum for providing a toner for said photo-sensitive drum;

a cleaning roll of a cleaning unit positioned on a second side of said photo-sensitive drum for removing an excess toner from said photo-sensitive drum;

first gearing means attached on a first end of sad photo-sensitive drum, said sleeve, and said cleaning roll, said first gearing means receiving a rotation force from drive means;

second gearing means attached on a second end of said photo-sensitive drum, said sleeve, and said cleaning roll for maintaining a uniform gap between said photo-sensitive drum and said sleeve, and between said photo-sensitive drum and said cleaning roll; and guide frame means attached to said first and second ends of said photo-sensitive drum for further maintaining a uniform gap between said photo-sensitive drum and said sleeve, and between said photo-sensitive drum and said cleaning roll.

6. A drive system as claimed in claim 5, wherein sad first gearing means comprises:

a first drum gear attached to said first end of the drum and receiving motive force, for rotating the drum;

a first sleeve gear attached to said first end of the sleeve and meshing with said first drum gear, for rotating the sleeve in response to said rotation of the drum;

a first cleaning gear attached to said first end of the cleaning roll and meshing with said first drum gear, for rotating the cleaning roll in response to said rotation of the drum.

7. A drive system as claimed in claim 5, wherein said second gearing means comprises:

a second drum gear mounted on a second end of the shaft of said photo-sensitive drum for preventing deviation of said photo-sensitive drum;

a second sleeve gear engaged with said second drum gear for preventing deviation of said sleeve; and a second cleaning gear engaged with said second drum gear for preventing deviation of said cleaning roll.

* * * * *

UNITED STATES PATENT AND TRADEMARK OFFICE

CERTIFICATE OF CORRECTION

PATENT NO. : 5,323,213
DATED : 21 June 1994
INVENTOR(S) : Byung-Seon AHN

It is certified that error appears in the above-indentified patent and that said Letters Patent is hereby corrected as shown below:

IN THE ABSTRACT

Line 7, change "drums" to --drum--.

| | | |
|---|---|---|
| Column 1, | line 8, | after "FIG", insert --1--, |
| | line 11, | after "voltage", insert --by an--; |
| | line 19, | delete ",.", |
| Column 2, | line 2, | delete "," (second occurrence), |
| | line 6, | change "A' to --a--, |

UNITED STATES PATENT AND TRADEMARK OFFICE

CERTIFICATE OF CORRECTION

PATENT NO. : 5,323,213
DATED : 21 June 1994
INVENTOR(S) : Byung-Seon AHN

It is certified that error appears in the above-indentified patent and that said Letters Patent is hereby corrected as shown below:

Column 2, line 6, change "A' to --a--,
line 39, after "28c" delete --sleeve--.
line 40, change "are" to --is--.

IN THE CLAIMS

Claim 4, Column 4, line 2, change "," to --;--.

Signed and Sealed this
Eleventh Day of July, 1995

*Attest:*

*Attesting Officer*

Bruce Lehman

BRUCE LEHMAN

*Commissioner of Patents and Trademarks*